US007302823B1

(12) United States Patent
Jackson et al.

(10) Patent No.: US 7,302,823 B1
(45) Date of Patent: Dec. 4, 2007

(54) GAUGE FOR PIPE BENDING MACHINE

(75) Inventors: Jimmie D. Jackson, Sand Springs, OK (US); Donald E. Lewis, Owasso, OK (US)

(73) Assignee: CRC-Evans Pipeline International, Inc., Houston, TX (US)

( * ) Notice: Subject to any disclaimer, the term of this patent is extended or adjusted under 35 U.S.C. 154(b) by 0 days.

(21) Appl. No.: 11/428,981

(22) Filed: Jul. 6, 2006

(51) Int. Cl.
*B21D 9/00* (2006.01)

(52) U.S. Cl. ..... 72/369; 72/31.05; 72/702

(58) Field of Classification Search ..... 72/16.2, 72/16.3, 17.3, 18.1, 18.2, 31.04, 31.05, 369, 72/702
See application file for complete search history.

(56) References Cited

U.S. PATENT DOCUMENTS

| | | | | |
|---|---|---|---|---|
| 3,335,588 | A | 8/1967 | Cummings | |
| 3,705,506 | A | 12/1972 | Clavin et al. | 72/21 |
| 3,731,513 | A | 5/1973 | Kindermann et al. | 72/295 |
| 3,834,210 | A | 9/1974 | Clavin et al. | 72/308 |
| 3,851,519 | A | 12/1974 | Calvin et al. | 72/466 |
| 4,080,814 | A | 3/1978 | Eaton | 72/32 |
| 4,122,697 | A | 10/1978 | Hanyo et al. | 72/128 |
| 4,649,726 | A | 3/1987 | Trammell et al. | 72/34 |
| 5,092,150 | A | 3/1992 | Cunningham | 72/369 |
| 5,259,224 | A * | 11/1993 | Schwarze | 72/20.5 |
| 5,275,031 | A * | 1/1994 | Whiteside et al. | 72/17.3 |
| 5,305,223 | A | 4/1994 | Saegusa | 364/472 |
| 5,481,891 | A * | 1/1996 | Sabine | 72/149 |
| 5,651,638 | A * | 7/1997 | Heggerud | 405/184.1 |
| 5,682,781 | A * | 11/1997 | Schwarze | 72/149 |
| 5,697,240 | A | 12/1997 | Parker | 72/31.05 |
| 6,164,113 | A * | 12/2000 | Parker | 72/388 |
| 6,253,595 | B1 | 7/2001 | Lewis, Jr. | 72/369 |
| 6,354,123 | B1 * | 3/2002 | Rajagopalan et al. | 72/31.01 |
| 6,980,880 | B1 * | 12/2005 | Ramsey | 72/31.04 |

* cited by examiner

*Primary Examiner*—David B Jones
(74) *Attorney, Agent, or Firm*—Sidley Austin LLP

(57) ABSTRACT

A pipe bending system employing a sensing and indicating system that provides feedback to an operator regarding the position of components of the pipe bending system, such as the pin-up shoe and the stiffback. Apparatus for retrofitting a sensing and indicating system to existing pipe bending apparatus.

20 Claims, 4 Drawing Sheets

GAUGE FOR PIPE BENDING MACHINE

TECHNICAL FIELD OF THE INVENTION

The present invention relates in general to pipe bending apparatus, and more particularly to apparatus for improving the speed and accuracy of forming bends in large-diameter pipes such as the type utilized for pipelines carrying petrochemicals, and the like.

BACKGROUND OF THE INVENTION

Throughout the world liquids and gases, such as fuels, are distributed through pipeline networks. The pipelines generally constitute large 40 foot long, 6-60 inch diameter sections of pipe that are welded together and buried underground. The pipelines follow the general contour of the earth and must be routed around natural and man-made obstacles. Rather than forming curves in a pipeline by welding short sections of pipe at angles to each other, curves are formed by bending sections of pipe on site as the pipeline is being built. Bending the pipe minimizes the number of welds and enhances the reliability of the resulting pipeline. Because of the size of the pipes being bent, pipe bending equipment is generally massive in nature and hydraulically operated. Typically, hydraulic pressure for operating the pipe bending equipment is provided by a hydraulic pump driven by an internal combustion engine. Such pipe bending machines are disclosed in U.S. Pat. Nos. 3,834,210; 3,851,519; and 5,092,150, the disclosures of which are incorporated herein by reference.

As is customary with large diameter pipes, a bend in each pipe is accomplished by making numerous small bends, each spaced from the other along the length of the pipe. For example, several half-degree, incremental bends spaced along a length of pipe may be used to create an overall curve of several degrees. The operator of a pipe bending machine is in full control of the number of incremental bends to be made, the spacing between the incremental bends, as well as the extent of each incremental bend in the pipe. Skilled operators can efficiently control a pipe bending machine to consistently form accurate bends in the pipes, while minimizing pipes that are damaged, under bent, or over bent. While it is possible to make consistent bends, to a certain extent, variations occur due to the skill and judgment of an operator and to differences between operators.

As will be described below, consistently achieving accurate, consistent, damage-free, pipe bends is dependent on the proper positioning of the pipe, stiffback, and pin-up shoe of the pipe bending machine. Typically, positioning the stiffback and/or pin-up shoe is done by a combination of visual, tactile, and/or audible cues that an operator acquires through experience. For example, an experienced operator can determine when the pin-up shoe is properly positioned by listening for a change in the sound of the engine. However, a lack of experience, fatigue, distractions, and environmental considerations may lead to improper positioning of the stiffback and/or pin-up shoe, contributing to variations in pipe bends or even damage to a pipe. It would therefore be desirable to provide a system to aid the operator in positioning the pin-up shoe and stiffback.

Ensuring that the pipe and pin-up shoe are properly positioned is also time-consuming. First, the stiffback is raised to bring the pipe just to the point of contact with the bending die. This is called the 'level' or 'zero' position. The pin-up shoe is then brought up to support the free end of the pipe. The stiffback is then raised or pivoted to incrementally bend the pipe around the bending die. Finally, the stiffback and pin-up shoe are lowered. If further bends are required, the pipe is moved axially to a new bend position, the stiffback and pipe are brought to the level position, the pin-up shoe is raised to support the pipe, and then the stiffback is raised to bend the pipe. Bringing the stiffback and pipe to the level position prior to each bend so that the pin-up shoe can be accurately positioned reduces the throughput of the pipe bending machine. It would therefore be desirable to provide a system to speed up pipe bending by reducing the time needed to position the pipe, stiffback, and/or pin-up shoe. It would also be desirable to eliminate the need to bring a pipe to the level position prior to each bend.

It can be seen from the foregoing that a need exists for a system to aid the skilled operator in forming incremental bends with a high degree of repeatability and accuracy, and to improve the speed at which pipes may be bent. Because existing pipe bending machines lack such a system, a further need exists for a system that is easily retrofitted to existing pipe bending machines.

SUMMARY OF THE INVENTION

In accordance with the principles and concepts of the present invention, there is disclosed an system of sensors and indicators, and a method of operation thereof, which overcome the disadvantages and shortcomings of the prior art. In accordance with the preferred embodiment of the invention, a system of sensors and indicators is disclosed, which enables a skilled operator to quickly and consistently position and bend a pipe.

According to one form of the invention, one or more sensors are coupled to the stiffback and/or pin-up shoe. The position sensors are connected to a display or to indicators that provide information to the operator on the position of the pin-up shoe and stiffback. Additional sensors and indicators may provide information on the axial movement of the pipe. With the aid of feedback provided by the sensors and indicators, the skilled operator can control the pipe bending system so as to rapidly and consistently form accurate bends in pipes.

BRIEF DESCRIPTIONS OF THE DRAWINGS

Further features and advantages of the present invention will become more apparent from the following detailed description of various preferred embodiments of the invention, taken in conjunction with the accompanying drawings, in which like reference characters generally refer to the same parts throughout, and in which:

FIGS. 1A-C are side views of a typical pipe bending system, showing the operation of placing a bend in a pipe;

DETAILED DESCRIPTION OF THE INVENTION

Figure 1A:
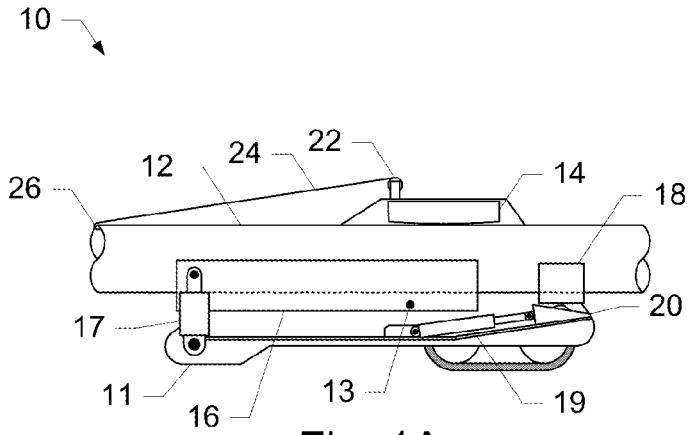
Figure 1B:
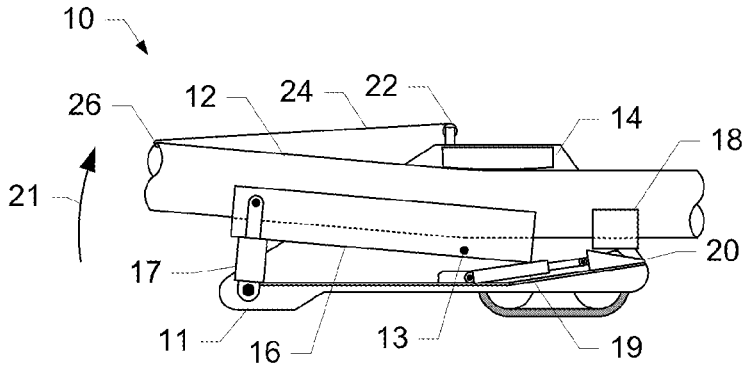
Figure 1C:
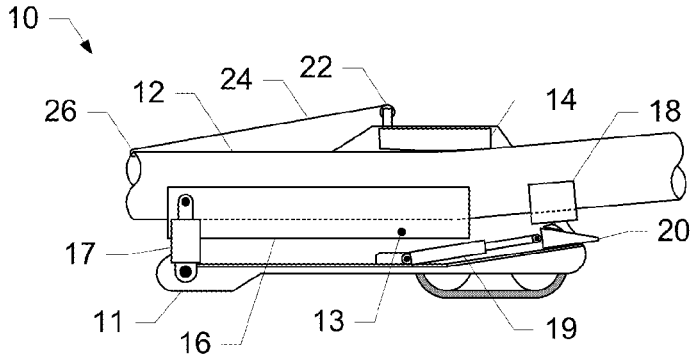

FIGS. 1A-C show a simplified representation of pipe bender 10 for forming bends in large diameter pipe, such as pipes 12 preferably having diameters between 22-36 inches, as well as other pipe diameters. Pipe bender 10 can accommodate pipes 12 of standard length, which in the industry is about 40 feet. Longer or shorter pipes as well as pipes having larger or smaller diameters can, of course, be operated upon by pipe bender 10. In general, pipe bender 10 includes a number of components mounted on frame 11.

The primary components of pipe bender 10 include bending die 14, stiffback 16, and pin-up shoe 18. Bending die 14 has a saddle-shaped bottom surface against which pipe 12 is forced during the bending operation. Bending die 14 is stationary with respect to frame 11. As can be seen in FIGS. 1A-C, bending die 14 is engaged with the top surface of pipe 12. Pipe 12 is supported on its bottom surface by stiffback 16 and pin-up shoe 18.

Stiffback 16 cradles pipe 12, and is movable or pivotable about horizontal axis 13 to raise one end of pipe 12 so as to bend the pipe around bending die 14. Hydraulic clamps hold the ends of pipe 12. Bending die 14 and stiffback 16 operate in conjunction with an internal pipe bending mandrel (not shown), which allows pipe 12 to be bent without crushing or otherwise internally deforming the circular nature of pipe 12 at the bend. Internal mandrels are well known in the art.

Hydraulic cylinder 17 raises or lowers one end of stiffback 16. Raising stiffback 16 forces one end of pipe 12 upward. The opposite end of pipe 12 is supported by pin-up shoe 18, which is raised or lowered by hydraulic cylinder 19. Pin-up shoe 18 is raised to support pipe 12 in a fixed position while the pipe is bent, and then lowered so that the pipe can be moved axially to another location for forming another incremental bend.

FIG. 1B illustrates stiffback 16 being pivoted in the direction of arrow 21 to form a bend in pipe 12 around the curved surface in bending die 14. Each pipe is generally individually bent through a specific angle at a specific location along the pipe. Each bend placed in pipe 12 by pipe bender 10 is limited to a certain number of degrees to avoid damage to pipe 12. Typical pipe benders can generally form bends of one degree or less during a single bending operation. Thus, if a greater curvature is required in a specific pipe 12 than is possible with a single bending operation, pipe 12 must undergo a number of incremental bending operations, spaced apart from each other a specified distance along the length of pipe 12. For example, to bend a pipe through a total of five degrees a series of five one-degree, incremental bends spaced approximately 12 inches apart may be used. Winch 22 and cable 24 can be used to move pipe 12 axially by engaging the end of pipe 12 with hook 26. Alternatively, pipe 12 may be moved axially by a set of power rollers as described in detail in U.S. Pat. No. 5,092,150, by Cunningham.

Pin-up shoe 18 is of conventional design such that it can support pipe 12 irrespective of the orientation of the pipe. In practice, pin-up shoe 18 will initially clamp to the end of the pipe, which at that time is level or horizontal over its entire length. After the first incremental bend, both ends of pipe 12 can no longer be at a level or horizontal position. Rather, the stiffback end of pipe 12 is always maintained at a level position, while the pin-up end of pipe 12 is allowed to become elevated above the level position. This is shown in FIG. 1C. After each incremental bend, the pin-up end of pipe 12 raises higher to enable the stiffback end to maintain its level orientation. Hence, pin-up shoe 18 is structured to grasp the respective end of the pipe at whatever elevation it may assume, and to accurately and firmly maintain such elevation during the next incremental bending operation.

Typically, stiffback 16 and pin-up shoe 18 are positioned by hydraulic cylinders. A control station is provided from which an operator of pipe bender 10 initiates and otherwise controls a bending operation. Controls are provided to selectively applying hydraulic pressure to the hydraulic cylinders. For example, a control may apply hydraulic pressure to hydraulic cylinder 17 to raise or lower stiffback 16. When raising pipe 12 to the level position, the operator may look for the position of pipe 12 with respect to bending die 14 and may also monitor hydraulic pressure. Similarly, another control applies hydraulic pressure to hydraulic cylinder 19 so as to raise or lower pin-up shoe 18 to pipe 12. Additional controls are used to operate other components of pipe bending machine 10, such as winch 22 and/or power rollers, if provided. The controls may be hydraulic or electrical.

When moving stiffback 16 or pin-up shoe 18, the hydraulic pressure needed corresponds to the amount of resistance to the desired motion. When pin-up shoe 18 is raising pipe 12 relatively little hydraulic pressure is needed. However, when pipe 12 comes into contact with die 14, the hydraulic pressure in the cylinder begins to increase, loading the engine. Based on experience, the operator stops moving pin-up shoe 18 when support for the end of the pipe is ensured. For example, proper pin-up shoe position may be indicated by a change in the sound of the engine driving the hydraulic pump. Hydraulic pressure or the lifting of a pressure relief valve can also be used to determine proper pin-up shoe position.

Judging the position of the stiffback and/or pin-up by experience is imprecise and error prone. Therefore, in accordance with the principles of the present invention, sensors and indicators are provided to directly sense, detect, and display the position of the pipe, pin-up shoe, and/or stiffback. Specific sensors and indicators may be used to implement the present invention depending on operational requirements.

Figure 2:
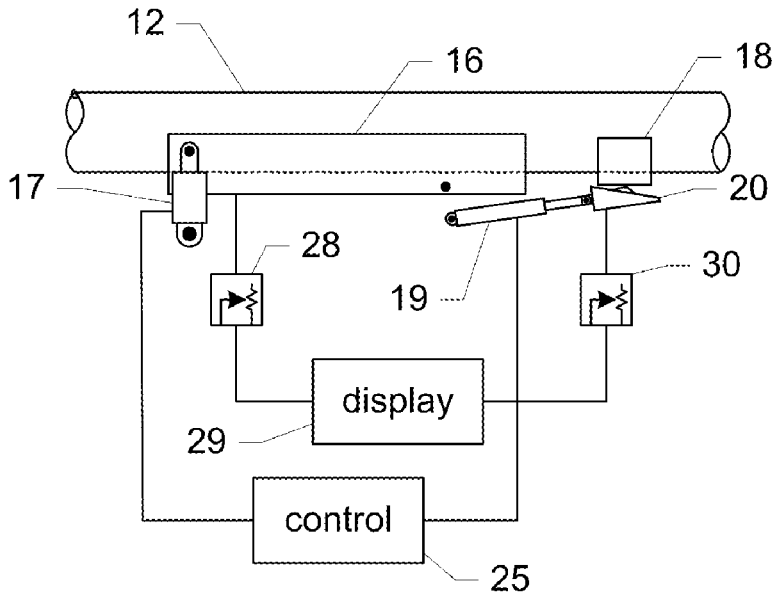
FIG. 2 is a schematic representation of a sensor and indicator system in accordance with the principles of the invention.

The major system components are shown schematically in FIG. 2. As described above, stiffback 16 and pin-up shoe 18 are positioned by hydraulic cylinders 17 and 19, respectively, under the control of an operator at control panel 25. Sensors 28 and 30 are coupled to stiffback 16 and pin-up shoe 18, respectively, to obtain position information. Display panel 29, which is coupled to the outputs of sensors 28 and 30, provides the operator a visual indication of the positions of stiffback 16 and pin-up shoe 18.

In a first embodiment of the invention, the positions of the pin-up shoe and/or stiffback are detected by limit switches and displayed by indicator lights. For example, one or more limit switches may be mounted on frame 11 in the vicinity of stiffback 16 and/or pin-up shoe 18, or their respective operating cylinders and related structures. If needed, the limit switches may be mounted on a stanchion, bracket, or other rigid support attached to pipe bending machine 10. The limit switches are located such that the limit switches open or close when the stiffback 16 or pin-up shoe 18 are in predetermined positions.

Figure 3:
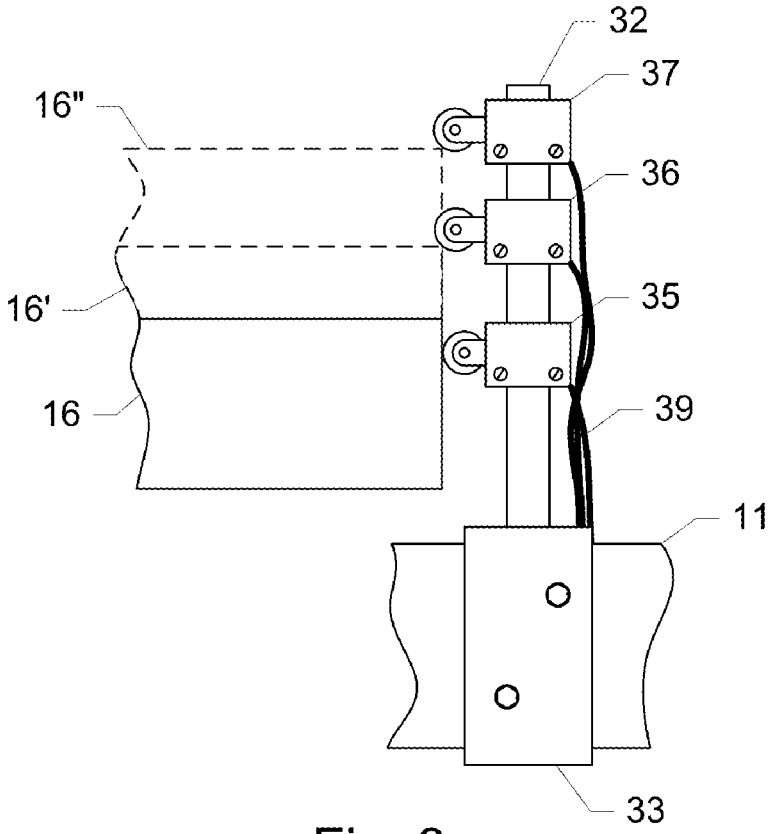
FIG. 3 is a first illustrative position sensor.

An illustrative arrangement of limit switches is shown in FIG. 3, wherein limit switches 35-37 are attached to stanchion 32 at various points along its length. Stanchion 32 is mounted to bending machine 10 such that the limit switches are close enough to a portion of stiffback 16 so that one or more of the limit switches are operated by stiffback 16 as it is raised or lowered. As shown in FIG. 3, when stiffback 16 is in the position shown in solid lines switch 35 has been actuated; whereas switches 36 and 37 are actuated when the stiffback is at positions 16' and 16" shown in dashed lines. Preferably, the positions of limit switches 35-37 are mounted to stanchion 32 in such a manner that their position along the length of stanchion 32 may be adjusted as desired.

Figure 4:
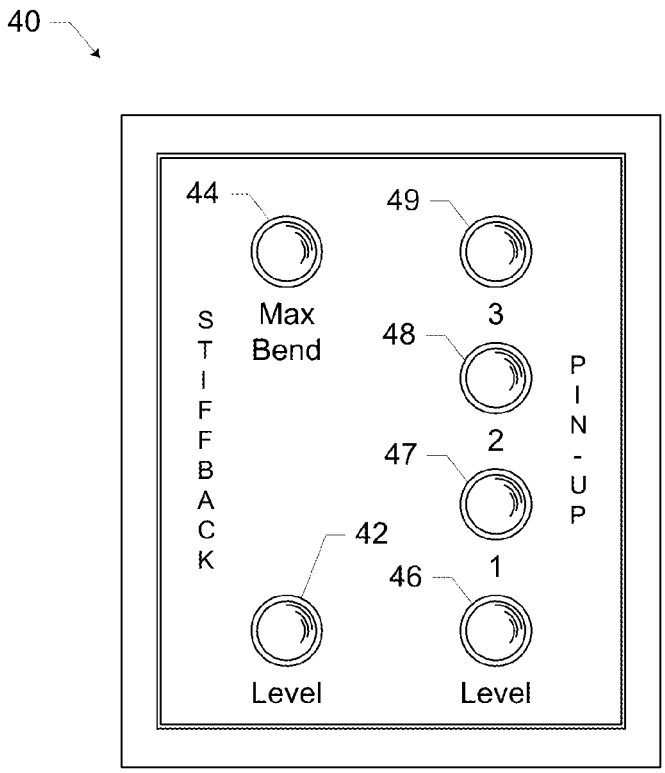
FIG. 4 is a first illustrative embodiment of an indicator panel.

The limit switches are connected to a display device to indicate when the stiffback and/or pin-up shoe are in predetermined positions. An exemplary display is shown in FIG. 4, wherein indicator lights are used to inform the operator of the position of the monitored element of machine 10. In one embodiment of the invention, limit switches 35-37 directly switch the corresponding indicator lights on a display panel. For example, when stiffback 16 is at the level position, limit switch 35 may be closed causing indicator light 42 to illuminate. Additional indicator lights may indicate other positions. For example, limit switch 37 may turn on indicator light 44 to indicate that stiffback 16 is at the desired height at the end of a bending operation. Indicator lights 46 to 49 may indicate that pin-up shoe 18 is in positions corresponding to performing a first, second, or third bend. Preferably, the positions of limit switches 35-37 along the length of stanchion 32 are adjustable so that positions to be indicated can be established depending on the size and/or type of pipe being bent.

The sensor and indicator system disclosed above may be used as follows. When putting a first bend in a first pipe, the operator operates the controls of machine 10 to position stiffback 16 and pin-up shoe 18 in the conventional manner, i.e., by monitoring hydraulic pressure and other visual, tactile, and audible cues. At each step, the position of one or more of the limit switches is adjusted so that the stiffback 16 or pin-up shoe 18 can be returned to the same position based on the indicators. For example, when the pipe is at the level position, the limit switch connected to indicator light 42 is adjusted so that when the stiffback 16 is being raised to the level position on a subsequent bend, indicator light 42 illuminates when the stiffback 16 reaches the current position, e.g., the level position. Similarly, other limit switches may be adjusted to indicate the desired maximum raised position of the stiffback 16 during a bend, as well as the desired positions of the pin-up shoe 18 before the pipe is bent as well as after certain numbers of bends. For example, limit switches 35-37 may be adjusted so that limit switch 35 indicates the desired position of the pin-up shoe 18 when the pipe is unbent, limit switch 36 indicates the desired position when performing a second bend, and switch 37 indicates the desired position for performing a third bend.

Figure 5:
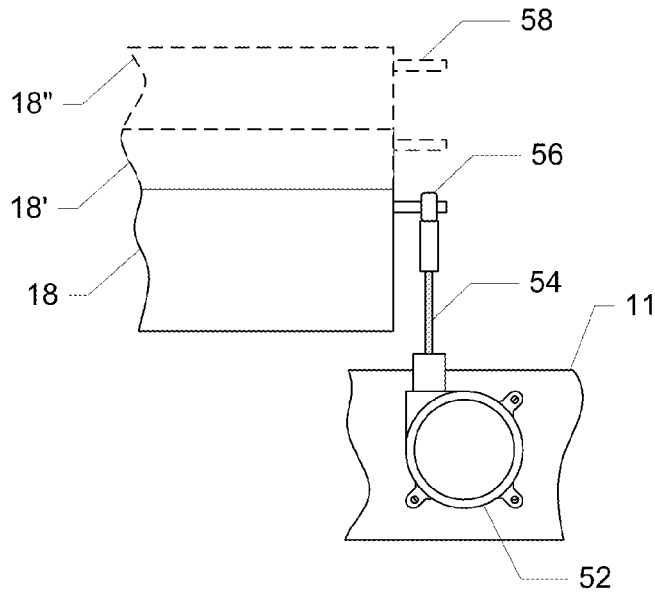
FIG. 5 is a second illustrative position sensor.

The limit switches and indicators of FIG. 3 are sufficient to indicate discrete positions of the stiffback 16 and/or pin-up shoe 18. However, adjusting the switches to accommodate different pipes requires physically moving the limit switches, which may be burdensome and time consuming. In an alternative illustrative embodiment of the present invention, the limit switches are replaced by a continuous position sensor or transducer. For example, the extent of movement of pin-up shoe 18 may be monitored and otherwise measured by position transducer 52 of FIG. 5. Similarly, the extent of movement of stiffback 16 may be monitored and otherwise measured by a similar position transducer. In the preferred form of the invention, position transducer 52 constitutes a cable-extension position transducer such as that identified as model P8510, obtainable from Celesco of Canoga Park, Calif. Clearly other types of transducers from other companies may also be suitable for use in the present invention. For example, optical, magnetic, ultrasonic, and/or electronic position sensors may be used.

The body of the position transducer 52 is fixed to the frame or other portion of pipe bending machine 10. Cable 54, which extends from position transducer 52 includes end 56 adapted to be coupled to stiffback 16. Accordingly, when stiffback 16 is raised or lowered the cable is either extended from or retracted into the body of position transducer 52. The extension or retraction of cable 54 is measured by position transducer 52, and a signal indicative of the measurement is provided. Typically, the signal is an analog signal, but can also be digital in nature. As can be appreciated, the position of stiffback 16 is directly related to the extent of a bend formed in pipe 12. Thus, the position of stiffback 16, as measured by position transducer 52, is an indication of the pipe bend angle. The signal from position transducer 52 is coupled to an indicator, wherein appropriate circuitry analyzes the signal and provides a display of the position of the stiffback.

In one embodiment of the present invention, position transducer 52 provides analog signals indicative of the positions of the stiffback 16 and pin-up shoe 18. For example, position transducer 52 may comprise a potentiometer that provides an analog voltage or current signal related to the extension of cable 54. Appropriate comparison circuitry may be used to turn an indicator light on when the voltage of an analog signal is within a preset range. The circuitry may be analog circuitry such as one or more comparators that detect when the signal is within the preset range. Threshold values of the comparators may be adjustable so that bending machine 10 may be used to bend pipes having different bending characteristics.

Alternatively, the circuitry may comprise an analog-to-digital converter to convert the analog signal to a digital value. A suitably programmed processor may then compare the digital value to previously stored threshold values. An output of the processor may then drive a display based on the comparison. For example, the processor could simply turn on an indicator light, such as those in FIG. 4, when it determines that the converted digital value lies within a preset range of values.

Instead of an analog signal, position transducer 52 may provide a digital signal related to the extension of cable 54. The transducer my indicate the extension of the cable by directly outputting a digital value indicative of the amount of cable extension. Or, the transducer may be an encoder that outputs pulses indicative of the movement of cable 54. The output of the transducer may be transmitted by a wired or wireless connection to a microprocessor, which is programmed to interpret the digital signal and drive a display. Preferably, the processor is programmed to enable easily changing various set points and indicators used by the processor software so that different pipes can be accommodated. A general purpose processor, such as a programmable logic controller, SLC500 series, obtainable from Allen-Bradley, of Milwaukee, Wis., is suitable for use in the present invention.

Figure 6A:
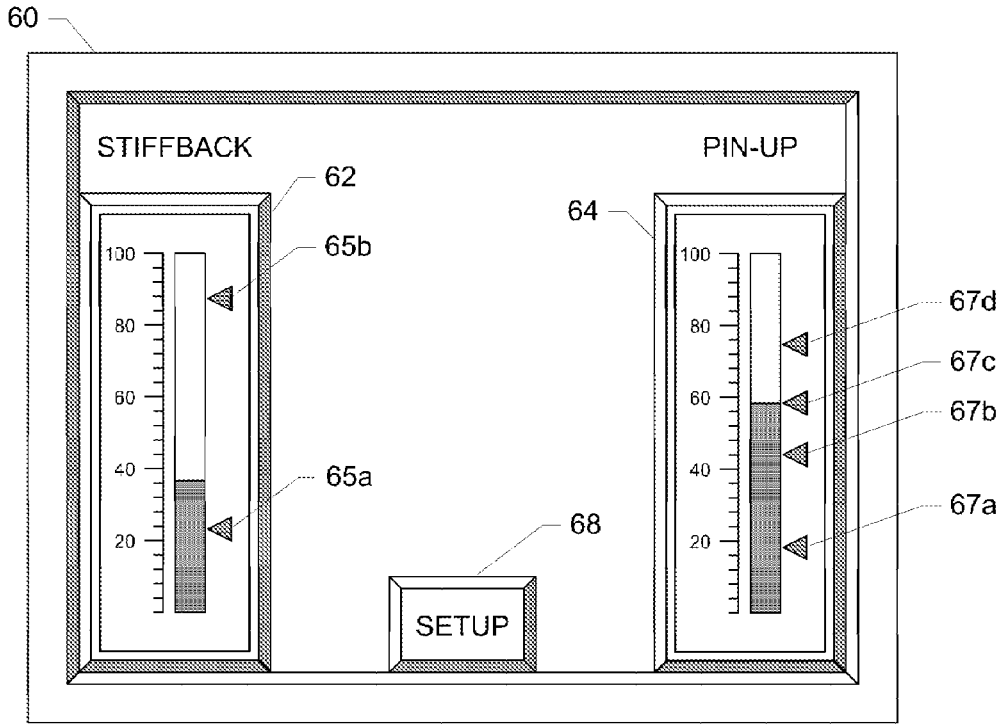
FIGS. 6A and 6B are views of an alternative illustrative embodiment of an indicator panel in accordance with the principles of the present invention.
Figure 6B:
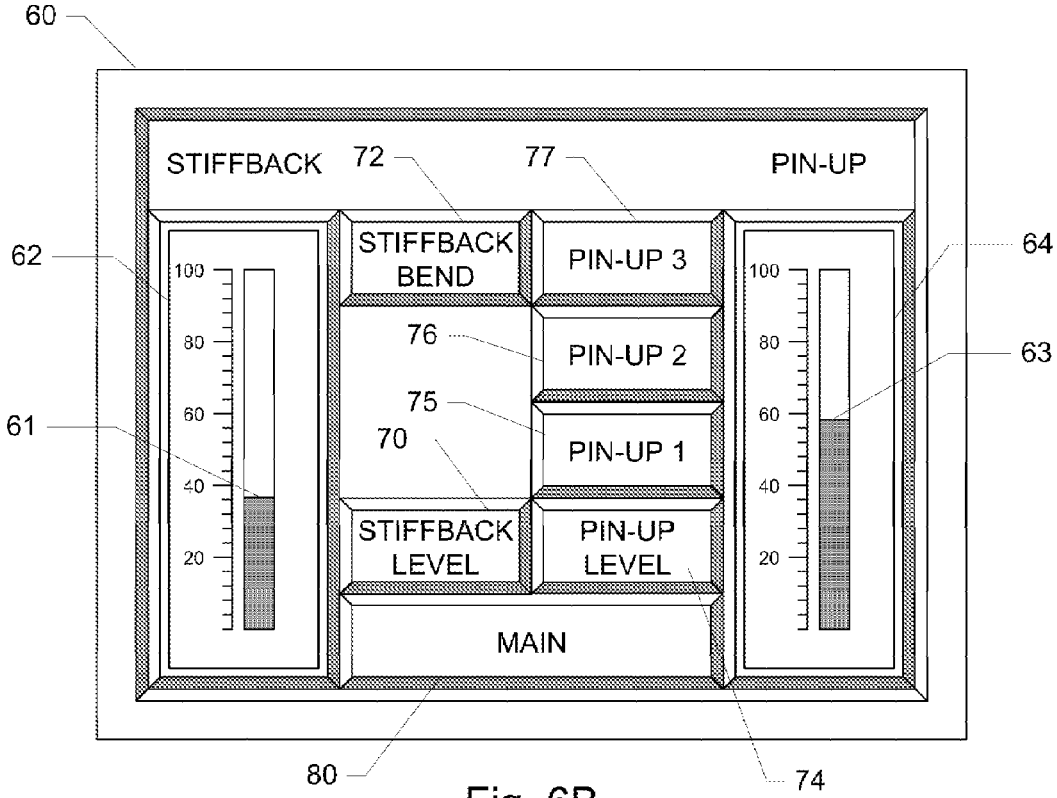

The display may comprise simple indicator lights such as those shown in FIG. 4, or may comprise a video screen, such as a CRT, LCD, or other type of display. An exemplary illustrative display is shown in FIGS. 6A and 6B, wherein display panel 60 includes an LCD display with a touch screen in accordance with a preferred embodiment of the present invention. During operation, the signal from position sensors 28 and 30 of FIG. 2 are received by the processor and displayed on a display panel. In FIG. 6, the positions of stiffback 16 and pin-up 18 are indicated on virtual gauges 62 and 64 as a percent of full range. For example, virtual gauges 62 and 64 show, respectively, that stiffback 16 is at approximately 38% and pin-up 18 is at approximately 59% of full range. In addition, various target positions are indicated by pointers 65*a-b* and 67*a-d*.

While operating bending machine 10, the indications shown on virtual gauges 62 and 64 changes while stiffback 16 and/or pin-up shoe 18 are raised an lowered. Pointers 65*a-b* and 67*a-d* mark specific positions of these bending machine components. For example, pointers 65*a* and 67*a* may correspond to the zero or level position of the stiffback 16 and pin-up shoe 18; whereas, pointer 65*b* indicates the maximum bend position of the 37 and pointers 67*b-d* indicate pin-up shoe 18 positions for the second, third, and fourth bend. The pointers are set when performing bends on a first pipe. The pointers may then be relied on while bending subsequent pipes.

First, pipe 12 is inserted horizontally through the pin-up shoe 18 until the front end of the pipe rests fully on the stiffback 16. The internal mandrel is then driven into the pipe until it is registered with respect to the bending die 14 in the manner described in U.S. Pat. No. 5,651,638 by Heggerud, the disclosure of which is incorporated herein by reference. Stiffback 16 is raised until pipe 12 is level and it just touches the lowest point of the undersurface of bending die 14. When in this position, the operator accesses the setup screen by touching on the display panel 60 in the area of setup button 68 shown in FIG. 6A. An illustrative setup screen is shown in FIG. 6B.

As the operator proceeds through the steps of bending the first pipe, the various pointers are set by touching the corresponding button on the setup screen. For example, when the stiffback 16 is at the zero or level position, the operator touches STIFFBACK LEVEL button 70, whereupon the processor stores an indication of the present position of the stiffback as determined by position sensor 28 of FIG. 2, and adjusts the display of pointer 65*a* accordingly. Similarly, when stiffback 16 is raised to the maximum bend position, the operator touches STIFFBACK BEND button 72 and the processor stores the position information and updates pointer 65*b*. Pointers 67*a-d* are set in a similar fashion by positioning pin-up shoe 18 and touching the corresponding button. When all the setpoints and pointers have been set, touching MAIN button 80 returns the display to the operational screen of FIG. 6A.

Thus, an operator sets the setpoints by raising the stiffback 16 to the level position and pressing the STIFFBACK LEVEL button 70. The operator then raises the pin-up shoe 18 for engagement with the pipe 12. This constitutes the initial position of the pin-up shoe 18 for starting the first incremental bend of pipe 12. The position of the pin-up is entered into the processor by operating the PIN-UP LEVEL button 74.

The maximum extent by which a pipe will be bent constitutes a "bend maximum set point", which relates to the maximum raised position of the stiffback 16 in forming a curvature in the pipe, including any spring back of the pipe 12. This may also be the maximum position that the stiffback cylinder will travel. Any attempt to bend the pipe 12 beyond the bend maximum set point may result in damage to the pipe.

Pipe 12 is bent by raising stiffback 16 upwardly until pipe 12 "fills" the concave undersurface of bending die 14, i.e., until the pipe 12 is in contact with the die surface from the center of the bending die 14 to the frontal edge thereof, and until the pipe has been bent through the desired bend angle, taking into account any expected spring back. As with the level position of stiffback 16, this position of the stiffback may be entered into the processor by pressing the STIFFBACK BEND 72 button on the setup screen. Pin-up shoe 18 and stiffback 16 are then lowered. The mandrel is retracted and pipe 12 is moved axially to prepare for the next incremental bend.

In a most preferred embodiment of the present invention, pipe bending machine 10 also includes a sensor to determine the axial movement of pipe 12 such as when pipe 12 is positioned for a second or third incremental bend. The display panel may then indicate when pipe 12 has been moved by a specified distance. For example, display panel 60 may include an indicator light that illuminates when pipe 12 has been moved axially a distance of 12 inches relative to the prior bend. Alternatively, a running indication may be kept of the total axial movement of pipe 12. An exemplary sensor for axial movement of pipe 12 is disclosed in U.S. Pat. No. 6,253,595 to Donald Lewis.

Note that the first time a particular incremental bend in a series of bends is performed, the corresponding position of the pin-up shoe is saved in the processor by an appropriate button on the setup screen. For example, in FIG. 6B buttons are provided for storing the position of the pin-up shoe after one, two, or three incremental bends have been performed. Advantageously, the setup procedure only has to be done the first time a given bend is performed. When bending subsequent pipes of the same size and characteristics the values stored during setup may be used.

In accordance with the principles of the present invention, once the positions of stiffback 16 and/or pin-up shoe 18 are established, e.g, by adjusting the limit switches or storing the position signals from the position transducers, is no longer necessary to level or zero a pipe before placing a bend in the pipe. That is, after a pipe is loaded into pipe bender 10, pin-up shoe 18 is raised to a previously established pin-up shoe position. Then stiffback 16 is raised to a previously established stiffback position. This eliminates the leveling step, thereby reducing the time needed to place a bend in a pipe.

From the foregoing, a sensor and indicator system is disclosed which provides operator feedback on the operation of a pipe bending machine and thereby enables the operator to perform highly accurate bends in the pipe in a repeatable manner. While the preferred embodiments of the method and apparatus have been disclosed with reference to a specific pipe bending system, it is to be understood that many changes in detail may be made as a matter of engineering and software choices without departing from the scope of the invention as defined by the appended claims. For example, instead of using a touch screen for an operator interface, as shown in FIGS. 6A and 6B, separate display and buttons may be used. Indeed, those skilled in the art may prefer to embody the apparatus in other forms, and in light of the present description it will be found that such choice can be easily implemented. Also, it is not necessary to adopt all of the various advantages and features of the present disclosure into a single composite pipe bending system in order to realize the individual advantages. Accordingly, such features are individually defined in the appended claims.

What is claimed is:

1. Pipe bending apparatus, comprising:

a pin-up shoe for clamping to a pipe;

a first sensor for sensing relative positions of said pin-up shoe;

a bending die;

a stiffback for supporting the pipe, said stiffback being movable with respect to said pin-up clamp for moving a portion of said pipe and forming a bend therein;

a second sensor for sensing relative positions of said stiffback; and an indicator coupled to the first and second sensors for providing an operator with an indication of the position of the stiffback and/or the pin-up clamp.

2. The pipe bending apparatus of claim 1, wherein the first and second sensors comprise a plurality of limit switches configured so that predetermined ones of the limit switches are activated when the stiffback and pin-up clamp are in predetermined positions.

3. The pipe bending apparatus of claim 2, wherein the positions of the plurality of limit switches are adjustable so that the predetermined positions may be changed.

4. The pipe bending apparatus of claim 2 wherein the indicator comprises a plurality of visual indicators that are activated responsive to the activation of a corresponding limit switch.

5. The pipe bending apparatus of claim 4, wherein the plurality of visual indicators comprise lights that are selectively energized responsive to corresponding ones of the limit switches.

6. The pipe bending apparatus of claim 5, wherein the lights are LEDs.

7. The pipe bending apparatus of claim 1, wherein the first and second sensors comprise first and second transducers that provide signals indicative of the position of the stiffback and pin-up clamp, respectively.

8. The pipe bending apparatus of claim 7, wherein signals are analog signals.

9. The pipe bending apparatus of claim 8, further comprising circuitry for comparing the analog signal to a predetermined threshold.

10. The pipe bending apparatus of claim 9, wherein the indicator comprises a plurality of visual indicators that are activated responsive comparing the analog signal to the predetermined threshold.

11. The pipe bending apparatus of claim 9, further comprising circuitry for indicating a position of the stiffback or pin-up responsive to comparing the analog signal to the predetermined threshold.

12. The pipe bending apparatus of claim 9, wherein the circuitry for comparing and the circuitry for indicating comprises a programmed processor coupled to a display device.

13. The pipe bending apparatus of claim 2 wherein the indicator comprises a plurality of visual indicators that are activated responsive to the activation of one of the plurality of limit switches.

14. Pipe bending apparatus, comprising:

a bending die;

a support member juxtaposed near a first end of the bending die and being movable with respect to said bending die for supporting a portion of a pipe;

a first sensor for sensing a position of said movable support member;

a bending member juxtaposed near a second end of the bending die and being movable with respect to said bending die for bending a pipe around the bending die;

a second sensor for sensing a position of said bending member;

an indicator coupled to the first and second sensors for providing an operator with an indication of the positions of the support member and the bending member.

15. The pipe bending apparatus of claim 14, wherein one of the first and second sensors comprise a plurality of limit switches configured so that predetermined ones of the plurality of limit switches are activated when the member being sensed is in predetermined positions.

16. The pipe bending apparatus of claim 14, wherein one of the first and second sensors comprises a transducer that provides position signals indicative of the position of the corresponding one of the support member and bending member.

17. The pipe bending apparatus of claim 16, wherein the indicator comprises a plurality of visual indicators that are activated responsive to the position signals.

18. The pipe bending apparatus of claim 17, further comprising a programmed processor coupled to a display device, wherein the plurality of visual indicators comprise portions of the display device that are displayed by the programmed processor responsive to the position signals.

19. A method of operating a pipe bending apparatus having a bending die, a support member juxtaposed near a first end of the bending die and being movable with respect to said bending die for supporting a portion of a pipe, and a bending member juxtaposed near a second end of the bending die and being movable with respect to said bending die for bending a pipe around the bending die, the method comprising:

loading a first pipe into the apparatus so that a portion of the first pipe is disposed near the bending die;

moving the support member to a first position so as to support the first pipe near the first end of the bending die;

setting the first position as a first predetermined position using a first position sensor for sensing a position of said support member;

moving the bending member to a second position so as to force the first pipe to bend around a portion of the bending die;

setting the second position as a second predetermined position using a second position sensor for sensing a position of said bending member.

20. The method of claim 19, further comprising:

removing the first pipe from the machine;

loading a second pipe into the apparatus so that a portion of the second pipe is disposed near the bending die;

moving the support member to the first predetermined position; and moving the bending member to the second predetermined position, so that the second pipe is bent substantially the same as the first pipe.

* * * * *